US008834306B2

(12) United States Patent
Doyle et al.

(10) Patent No.: US 8,834,306 B2
(45) Date of Patent: Sep. 16, 2014

(54) RACQUET WITH ELONGATED GROMMET BARRELS

(75) Inventors: Tim Doyle, Vista, CA (US); Thomas W. Travers, Delray Beach, FL (US); Christopher Crowther, Carlsbad, CA (US)

(73) Assignee: EF Composite Technologies, L.P., Carlsbad, CA (US)

( * ) Notice: Subject to any disclaimer, the term of this patent is extended or adjusted under 35 U.S.C. 154(b) by 345 days.

(21) Appl. No.: 13/187,312

(22) Filed: Jul. 20, 2011

(65) Prior Publication Data

US 2013/0023363 A1 Jan. 24, 2013

(51) Int. Cl.

| | |
|---|---|
| ***A63B 49/00*** | (2006.01) |
| ***A63B 49/02*** | (2006.01) |
| ***A63B 51/00*** | (2006.01) |
| *A63B 59/00* | (2006.01) |

(52) U.S. Cl.

CPC ..... *A63B 49/002* (2013.01); *A63B 51/00* (2013.01); *A63B 59/0092* (2013.01)

USPC ..... 473/522; 473/539; 473/540; 473/537

(58) Field of Classification Search

USPC ..... 473/539, 540, 537, 546, 524, 520, 521, 473/522

See application file for complete search history.

(56) References Cited

U.S. PATENT DOCUMENTS

| | | | | |
|---|---|---|---|---|
| 3,884,467 | A | 5/1975 | Sommer | |
| 4,204,681 | A | 5/1980 | Hall, Jr. et al. | |
| 4,220,335 | A | 9/1980 | Nobbs | |
| 4,889,337 | A | 12/1989 | Todd | |
| 4,913,434 | A | 4/1990 | Fischer | |
| 4,993,711 | A | 2/1991 | Deville et al. | |
| 5,092,016 | A | 3/1992 | Soong | |
| 5,137,274 | A | 8/1992 | Soong | |
| 5,169,146 | A | 12/1992 | Soong | |
| 5,251,895 | A | 10/1993 | Darling | |
| 5,290,031 | A | 3/1994 | Natsume | |
| 5,762,570 | A | 6/1998 | Shaw | |
| 5,944,624 | A | 8/1999 | Davis et al. | |
| 5,993,337 | A | 11/1999 | Janes et al. | |
| 6,050,909 | A | 4/2000 | Severa et al. | |
| 6,074,315 | A | 6/2000 | Yimoyines | |
| 6,217,466 | B1 * | 4/2001 | Yimoyines | 473/539 |
| 6,527,656 | B1 | 3/2003 | Cheng et al. | |
| 7,097,576 | B2 | 8/2006 | Filippini | |
| 2006/0172827 | A1 * | 8/2006 | Soekahar | 473/520 |

(Continued)

FOREIGN PATENT DOCUMENTS

| | | | | |
|---|---|---|---|---|
| JP | 07051407 A * | 2/1995 | | A63B 49/02 |
| WO | 8801186 A1 | 2/1988 | | |

OTHER PUBLICATIONS

Digital photographs created in 2010, of a Bergelin tennis racket in public use before 1998.

(Continued)

*Primary Examiner* — Raleigh W Chiu

(74) *Attorney, Agent, or Firm* — Perkins IP Law Group LLC; Jefferson Perkins

(57) ABSTRACT

A sports racquet with increased string vibration damping has grommets with elongated barrels. The barrels conform closely to the strings, are capable of absorbing vibration, and may be placed on the main strings, the cross strings, or both.

39 Claims, 11 Drawing Sheets

(56) References Cited

U.S. PATENT DOCUMENTS

| | | | | |
|---|---|---|---|---|
| 2006/0223659 | A1* | 10/2006 | Filippini | 473/540 |
| 2011/0039641 | A1* | 2/2011 | Severa et al. | 473/539 |
| 2011/0319206 | A1* | 12/2011 | Mace et al. | 473/522 |
| 2013/0023363 | A1* | 1/2013 | Doyle et al. | 473/522 |

OTHER PUBLICATIONS

Digital photographs created in 2010, of a Dunlop Max Tech tennis racket in public use before 1998.

Digital photographs created in 2010, of a Dunlop Revelation tennis racket in public use before 1998.

Digital photographs created in 2010, of a Maynard Airpower tennis racket in public use before 1998.

US AS International Searching Authority, International Search Report and Written Opinion of the International Searching Authority issued in connection with Application No. PCT/US2012/046003, Sep. 28, 2012.

International Bureau of WIPO, International Preliminary Report on Patentability issued in connection with Application No. PCT/US2012/046003, Jan. 30, 2014.

* cited by examiner

RACQUET WITH ELONGATED GROMMET BARRELS

BACKGROUND OF THE INVENTION

Today's sports racquets, such as tennis, racquetball, squash and badminton racquets, each have a frame with a head portion supporting a string bed, coupled to a shaft or handle. The size and length of the head varies, depending on the particular sport for which the racquet is being used. As the racquet strikes a projectile such as a ball or shuttlecock, the strings deflect and propel the projectile from the racquet. The resulting string vibration is transmitted to the frame of the racquet and eventually the handle or shaft, and, finally, to the hand, arm and shoulder of the user. This string vibration may cause user discomfort.

Vibration damping devices have been incorporated into racquets in an effort to absorb and reduce these uncomfortable and potentially harmful vibrations. While there are many different types of damping devices, most attempt to absorb the vibration in the string bed before it is transmitted to the frame. Many such devices attach to the strings themselves in or near the throat of the racquet and are made of a rubber or silicone-type material that is conducive to absorbing vibration. Because these devices must be lightweight in order to minimally affect the balance and feel of the racquet, and because many of them are located to be remote from the main racquet hitting area, they may not provide sufficient damping to significantly reduce the vibration. Further, many are difficult to install and some are prone to fall off during play.

However, grommets are usually incorporated into racquets to prevent premature string wear. Thus, it would be advantageous to incorporate a light-weight damping device into a racquet, near the hitting area, in the form of an elongated grommet, made from an elastic material that minimally affects the weight, balance and feel of the racquet, yet significantly reduces vibration in the string bed.

SUMMARY OF THE INVENTION

The problems mentioned above are solved by the invention, which in a first aspect provides a sports racquet. The sports racquet has a head, which laterally surrounds a string bed. The string bed resides in a plane, and a string bed boundary is formed at the intersection of the string bed plane and the interior surface of the head. A shaft of the sort used in tennis, squash, badminton, or some racquetball racquets, or a handle as used in other racquetball racquets, is connected directly to the head. The racquet further includes a frame having a plurality of grommet holes disposed around at least a portion of the head. The string bed has a plurality of strings at least some of which are received into respective grommet holes in the head.

On the exterior lateral surface of the head, elongate grommet strips are disposed adjacent to the grommet holes. Grommets are attached to the grommet strips at an angle to the grommet strip. Due to the flexibility and elasticity of the materials and due to the frame shape, the angle may vary. The grommets that are attached to the grommet strip are spaced apart to coincide with the grommet holes in the racquet and are inserted into the grommet holes. In an alternative embodiment of the invention, the grommets are not attached to a grommet strip. In still another embodiment, the long barreled grommets vary in length on the grommet strip.

A predetermined number of the grommets have vibration-damping, elongated barrels. In one embodiment, when inserted into the grommet hole, the elongated barrel extends into the string bed from the string bed boundary by about at least 0.55 inches. In other embodiments, the vibration damping elongated barrel extends into the string bed from the string bed boundary by at least 0.8 inches or even by at least 1.05 inches.

In a further aspect of the present invention, the grommets with elongated barrels are disposed on, or jacket, ones of the cross strings. For each cross string on which a grommet with an elongated barrel is disposed, a second grommet with an elongated barrel may be disposed at the opposed intersection of the string bed boundary and the cross string. Grommets with elongated barrels may also be disposed on every other cross string or on alternating sides, or on random strings where the specific placement of grommets is selected as a function of the balance point or other play characteristics (such as vibration) of the racquet. In one embodiment, the long barreled grommets on the cross strings extend into the string bed such that their free ends are no more than about 33 millimeters from the nearest or outermost main string. In still another embodiment, the long barreled grommets on the cross strings cover an area of 30% of the length of the cross string between the string bed boundary and the outermost main string. The grommets with elongated barrels can be disposed on only the cross strings which are at least five cross strings removed from the handle of the racquet. In a further aspect of the present invention, the grommets with elongated barrels are disposed on several adjacent cross strings.

BRIEF DESCRIPTION OF THE DRAWINGS

Further aspects of the invention and their advantages can be discerned in the following detailed description, in which like characters denote like parts and in which.

DETAILED DESCRIPTION

Figure 1:
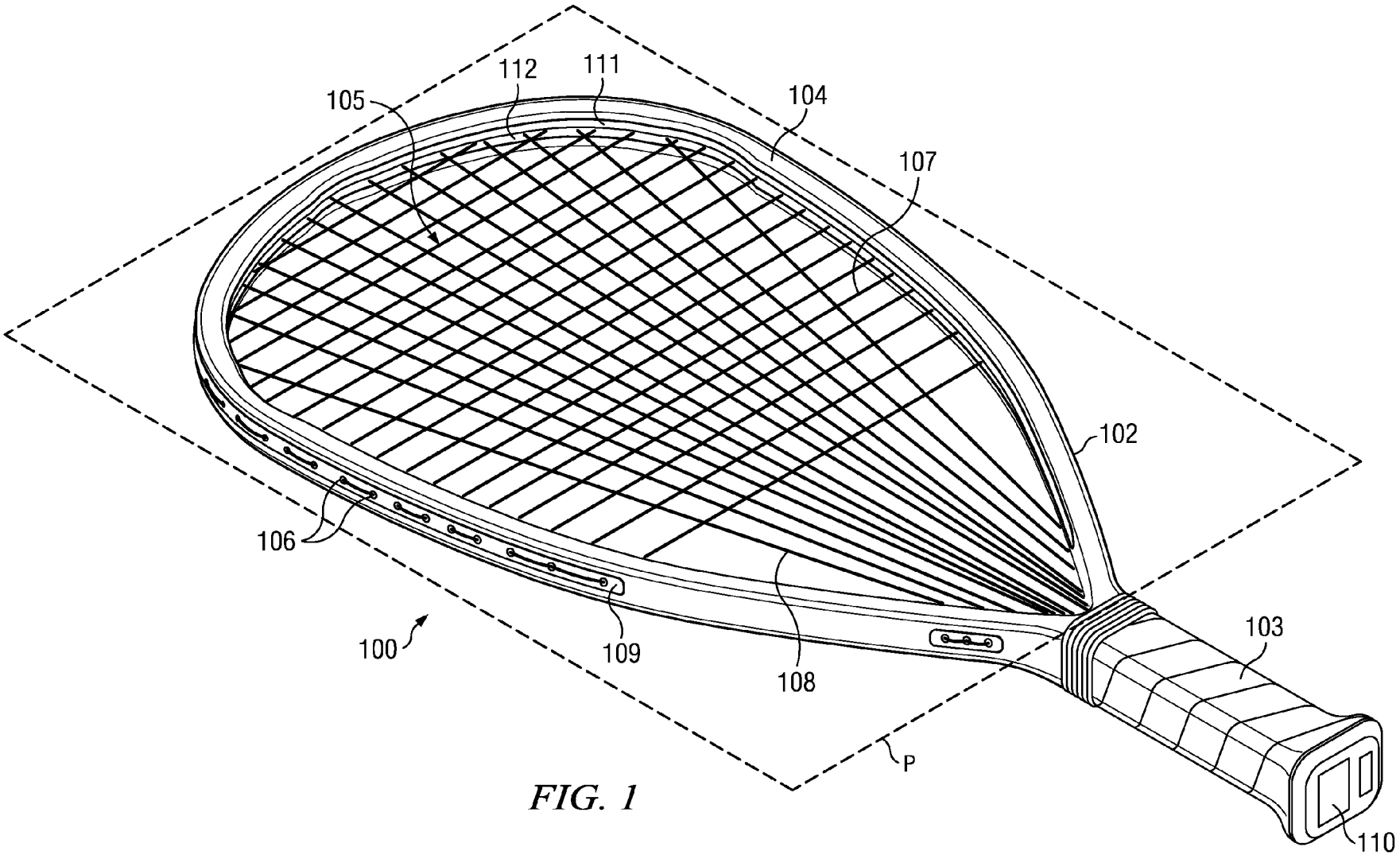
FIG. 1 is an isometric view of a sports racquet showing a head, a handle, a string bed, and grommets according to the prior art.

Referring to FIG. 1, a sports racquet, indicated generally at 100, has a frame 102 with a handle 103, a head 104, a string bed 105, and a plurality of grommet holes 106 disposed around at least a portion of the head 104. The frame 102 is defined to exclude any throat piece (not shown) or other structure at the throat area of the racquet where the head 104 and the handle 103 or shaft join. The string bed 105 resides in a string bed plane P. The string bed has a number of cross strings 107 that laterally traverse the head 104 of the racquet 100 and a number of main strings 108 that longitudinally traverse the head 104. Even though the cross strings 107 and main strings 108 are referred to in the discussion below as individual strings, it is contemplated that each of the cross strings 107 and main strings 108 are segments of a longer string or strings which are used to string the racquet 100. No limitation regarding the string bed, the strings themselves, the number, diameter, or length of the strings, the connectivity of the strings, the string physical or chemical composition, or any other string quality should be inferred by the discussion of the strings individually. Thus, each cross string 107 and main string 108 may have the same diameter as the other strings or may have its own separate string diameter. The cross strings 107 extend between and enter grommet holes 106. The frame head 104 has a laterally inward facing surface 112. A string bed boundary 111 is defined as the intersection of the plane P with surface 112. Grommet holes 106 each adjoin the string bed boundary 111. The grommet strip 109 is adjacent to the grommet holes 106.

As shown, sports racquet 100 may be a racquetball racquet of the "long string" type in which most or all of the main strings 108 are fed into a hollow handle 103 and are anchored at an anchor (not shown) at or near a handle end 110, or may be of a more conventional type in which some or all of the main strings have lower anchoring points on the frame 102 or throat piece (not shown). The invention may also be employed on other racquets such as those used for tennis or squash. If one end of a main string 108 is fed into a hollow handle, the opposing end will extend into a grommet hole 106 on top of the racquet. Otherwise, the main strings 108 will extend between and enter grommet holes 106.

Figure 2:
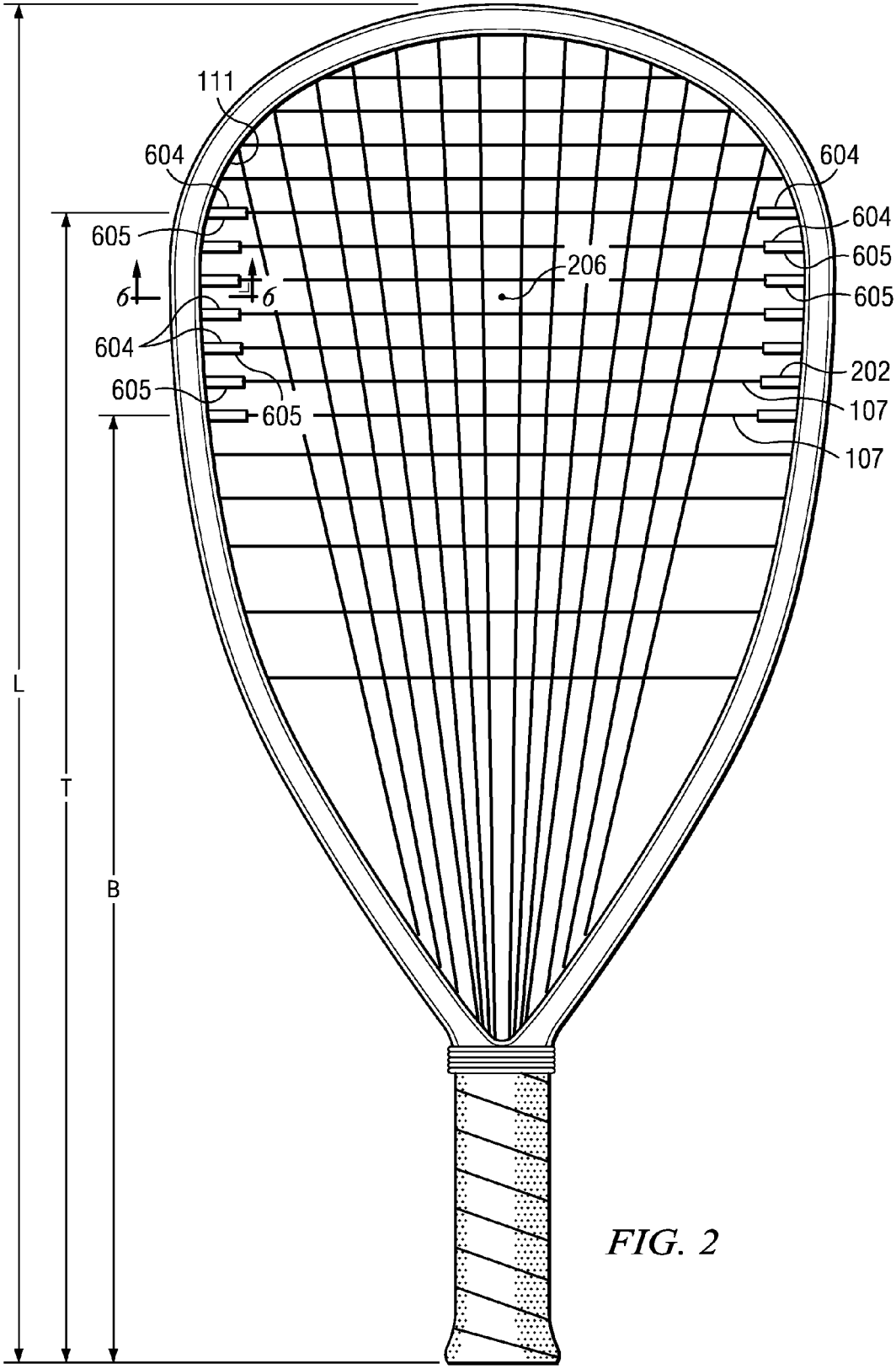
FIG. 2 is a plan view of a sports racquet according to the invention.

Referring to FIG. 2, a sports racquet 100 of the type of FIG. 1 is shown, but with long barrel grommets 202 disposed on seven cross strings 107. The cross strings 107 jacketed by grommets 202 may make up a portion of the "sweet spot," the center of which is illustrated by "x" 206, for the racquet or the specific location on the racquet string bed 105 where optimal contact with the projectile is desired. The sweet spot 206 is a general area on the string bed 105 where the coefficient of restitution is closest to one or at a maximum. The sweet spot 106 may vary according to user, string tension, materials, string type, frame construction, and style of play. Alternatively or additionally, the ones of cross strings 107 having long barreled grommets may all reside in the racquet hitting area, which extends from about the center of the racquet to the head end or tip opposite of the handle.

Figure 3A:
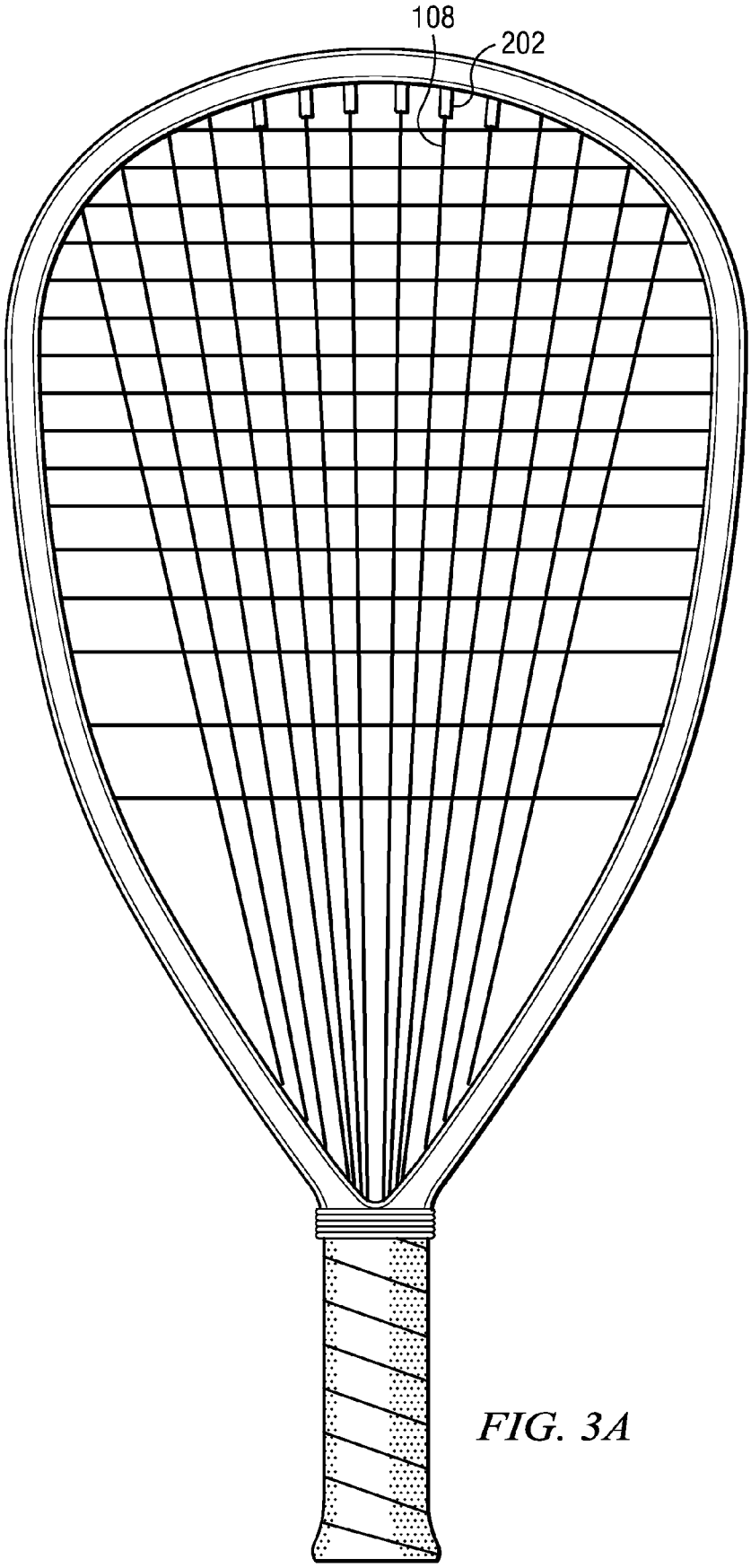
FIG. 3A is a plan view of an alternative embodiment of the invention, employing long barrel grommets on the main strings.

FIG. 3A shows an alternative embodiment with long barrel grommets 202 disposed on main strings 108 only.

Figure 3B:
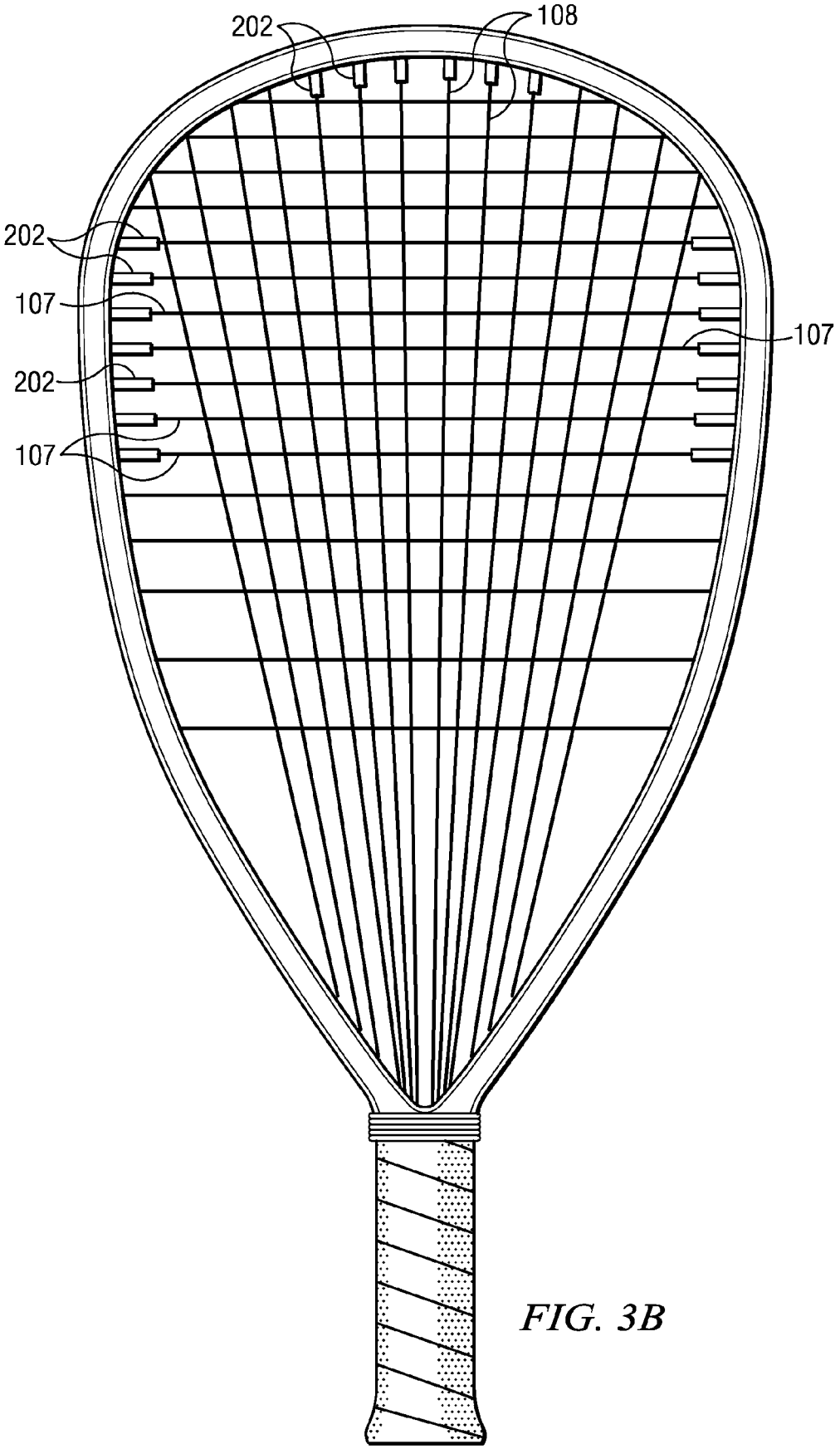
FIG. 3B is a plan view of an alternative embodiment of the invention, employing long barrel grommets on the main strings and the cross strings.

FIG. 3B shows an alternative embodiment with long barrel grommets 202 disposed on main strings 108 and cross strings 107.

Figure 4:
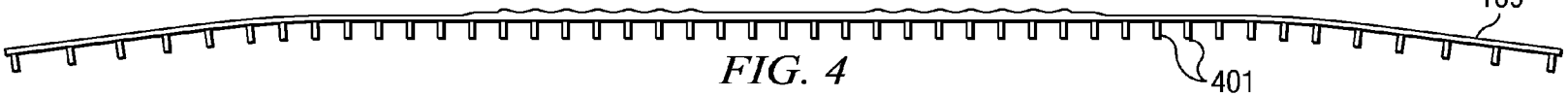
FIG. 4 (PRIOR ART)
FIG. 4 is a side view of the prior art grommet strip having grommets with short barrels.

Referring to FIG. 4, attached to the prior art grommet strip 109 are prior art grommets 401 that do not have an elongated vibration damping barrel. The prior art grommets 401 are typically of a length that extends about 0.12 inches into the string bed from the string bed boundary. The length of prior art grommets 401 is conventionally chosen to be enough to extend through frame 102 at a respective grommet hole 106. While grommets 401 are shown to be of uniform length, their length can be variable if the racquet head cross section thickness varies from place to place.

Figure 5:
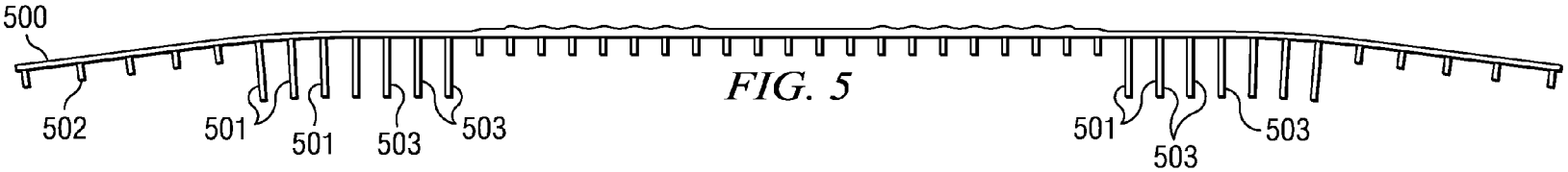
FIG. 5 is a side view of the grommet strip having grommets with elongated barrels.

Referring to FIG. 5, a grommet strip 500, according to the invention, has attached to it vibration damping grommets 501 with elongated barrels 503. The primary purpose for the elongated grommet barrels 503 is to dampen the vibration of the string bed 105 when the string bed 105 impacts a projectile. When the string bed 105 receives vibratory forces from the strike of a projectile, those forces are transferred to head 104 of the racquet 100 and eventually to the user. Grommets 501 may also act to produce a more stable playing surface. Also present on the illustrated embodiment of grommet strip 500 are grommets 502 that do not have elongated barrels. A grommet strip 500 may contain a combination of short grommets 502 and grommets 501 with elongated barrels 503, as well as a combination of grommets 501 with elongated barrels 503 of different lengths, depending on the application and vibration damping effects desired. Each grommet 501 with an elongated barrel 503 extends into the string bed 105 from the string bed boundary 111 by about at least 0.55 inches. More preferably, the grommets 501 extend into the string bed 105 from the string bed boundary 111 by about at least 0.8 inches or about at least 1.05 inches. While in the illustrated embodiment the entirety of the long-barrel grommets 501 are of uniform length, they could also vary according to any variance in frame thickness.

Figure 5A:
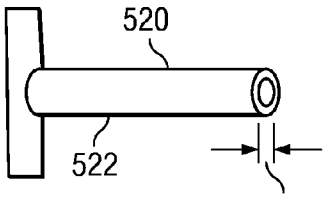
FIG. 5A is a detail of an individual grommet with an elongated barrel.

Referring to FIG. 5A, a single grommet 520 with an elongated barrel 522 may be provided separately from a multiple-grommet grommet strip 500. In both cases, the single grommet 520 and the grommet 501 on a grommet strip 502, the grommet 501, 520, has a barrel interior diameter 504 and a preferably a slightly tapered exterior diameter for ease in injection-molding the grommets 520. An individual grommet 520 may be extended through a respective grommet hole 106 (FIG. 2). Racquets 200 according to the invention may be provided with one or more grommet strips 500, a plurality of single long-barreled grommets 520, or both. It is contemplated that the grommets 501, 520 may be placed on one or more of the cross strings 107 (FIG. 2), or one or more of the main strings 108 (FIG. 3), or a combination of both (FIG. 3B). Different grommets 520 can be provided to be of different lengths.

Figure 6A:
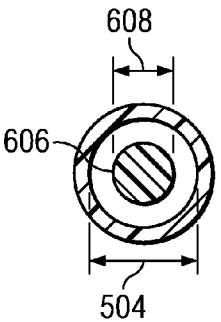
FIG. 6A is a cross section taken substantially along line 6A-6A of FIG. 6.
Figure 6:
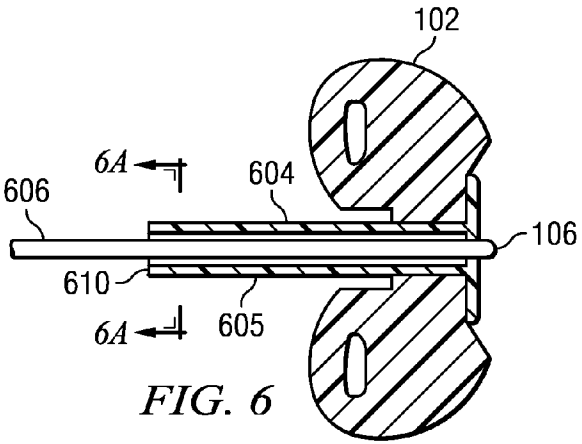
FIG. 6 is a sectional detail taken substantially along line 6-6 of FIG. 2.

Referring to FIG. 6, the illustrated frame 102 is a dual barrel frame, but no limitation as to the type of frame should be inferred. The frame 102 has a grommet hole 106 through which a grommet 604 with an elongated barrel 605 is inserted. The long barreled grommet closely encloses a string 606. For the purposes of this invention, a grommet barrel will be considered to closely enclose a string if it has a vibration-damping effect thereon. The string 606 may be a cross string 107 or a main string 108. Referring to FIG. 6A, the string 606 has a diameter 608. For example, the grommet 604 may have an interior diameter 504 that is in the range of about 1.2 times to about 1.5 times the string diameter 608. The interior diameter 504 is preferably about 1.5-1.6 millimeters for racquetball, tennis and squash applications. The tighter the fit between the string 606 and the barrel 605, the more vibration damping will occur, however the fit cannot be so tight that the string 606 cannot be pulled through the barrel 605. The grommet 604 may be attached to a grommet strip 500 (FIG. 5) or may be an individual grommet (FIG. 5A).

Figure 7:
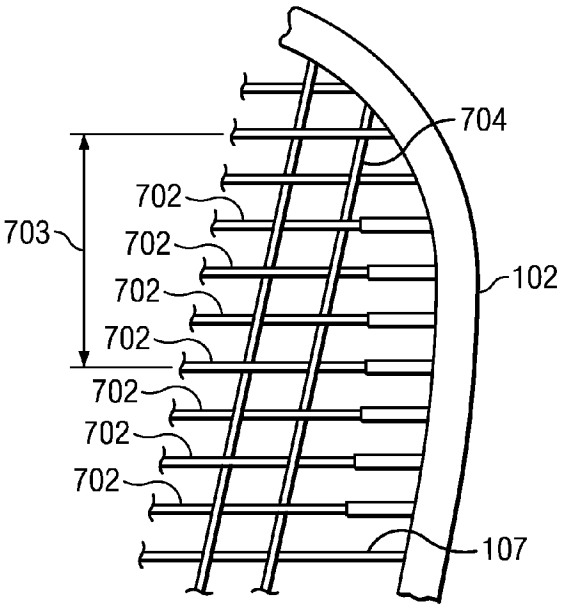
FIG. 7 is a detail showing the frame, grommet strips and strings.

Referring to FIG. 7, when a long-barrel grommet 604 is placed on a cross string 702, the grommet 604 will closely enclose the cross string 702 and in one embodiment will extend into the string bed 105 from the string bed boundary 111 to at least a distance of no more than 33 millimeters from the nearest main string 704. In the illustrated embodiment, the spacing is smallest on the topmost cross string 702 on which a long-barrel grommet 604 is disposed, and largest on the bottommost cross string equipped with a long-barrel grommet 604. In this embodiment and due to the shape of the head, and the angle of the outside-most main string 704, the distance between the free end 610 of the barrel 605 and the nearest main string 704 will increase the closer the cross string 702 is to the handle 103. Preferably, when the grommets 604 with elongated barrels 605 are placed on cross strings 702, the grommets are placed on several, such as at least seven adjacent cross strings 702. Additionally, for each cross string 702 on which a grommet 604 is disposed, usually there is a second grommet 604 with an elongated barrel 605 disposed at the opposed intersection of the string bed boundary 111 and cross string 702 (See FIG. 2). To maximize the placement of grommets 604 with elongated barrels 605 in the range of the sweet spot 206, in the illustrated embodiment, when the grommets 604 with elongated barrels 605 are placed on seven consecutive cross strings 702, the cross strings 702 on which the grommets are disposed are at least five cross strings removed from the handle 103. Stated differently, for a racquet with a length (L) of twenty-two inches, the location of the group of cross strings 702 upon which the grommets 604 are disposed can be in the range between about length (B) of 15.5 inches and length (T) of 19 inches from the terminus of the racquet handle 103 (See FIG. 2). In yet another embodiment, all of the cross strings 702 can have grommets 604 disposed upon them. Alternatively the long barrel-equipped or jacketed cross strings 702 can all reside within the racquet's hitting area.

Further referring to FIG. 7, the grommet 604 with an elongated barrel 605 covers a portion, but not all, of the cross string 702 between the string bed boundary 111 and the outside-most main string 704. The grommet 604 with an elongated barrel 605 covers about at least 30% of the length of the cross string 702 between the string bed boundary and the nearest main string 704. More preferably, the grommet with an elongated barrel covers about at least 44% of the length of the cross string 702 between the string bed boundary and the nearest main string 704. Even more preferably, the grommet with an elongated barrel covers about at least 58% of the length of the cross string 702 between the string bed boundary and the nearest main string 704.

The inventors have determined that a non-brittle polymer which will flex and not break upon the impact of a projectile into the string bed should be used for the grommets 604 with elongated barrels 605. The polymer should be more flexible than the frame, yet should still be plastic enough to exhibit damping properties. Preferably the polymer should have a flexural modulus in the range of 280-1730 MPa as measured under ISO 178 test methods. More preferably the flexural modulus is 390 MPa as measured under ISO 178 test methods. Preferably the polymer should have a Charpy Notched Impact Strength of between about 5 and 125 kJ/m2 under ISO 179 test methods. More preferably the polymer should have a Charpy Notched Impact Strength of 120 kJ/m2 at 23 degrees Celsius and 20 kJ/m2 at −30 degrees Celsius. Preferably the polymer should not break in Charpy Unnotched Impact Strength tests under ISO 178 test methods. A preferred polymer can be polyether block amide, such as the amide formulation sold under the mark PEBAX 7033 SP 1. Another polymer that may be considered is a polyamide, such as the formulations commercially available as nylon 11 or nylon 12.

Referring to FIGS. 10 through 13, the tests performed show that the elongated grommet barrels 605 significantly dampen post-strike string vibration in comparison to prior art, short-barreled grommets. Referring to FIGS. 8 through 13, the racquet that was tested was an E-Force® Heatseeker Model 170, strung with Oxygen™ 17 gauge string to a finish tension of 32 pounds. The Oxygen™ 17 gauge string is made from hundreds of composite microfibers bonded together. A number of trials were performed with varying grommet barrel lengths on the same seven cross strings (two grommets per cross string): (1) prior art grommets of about 0.12 inches; (2) grommets of about 1.05 inches; (3) grommets of about 0.8 inches; and (4) grommets of about 0.55 inches.

Figure 8:
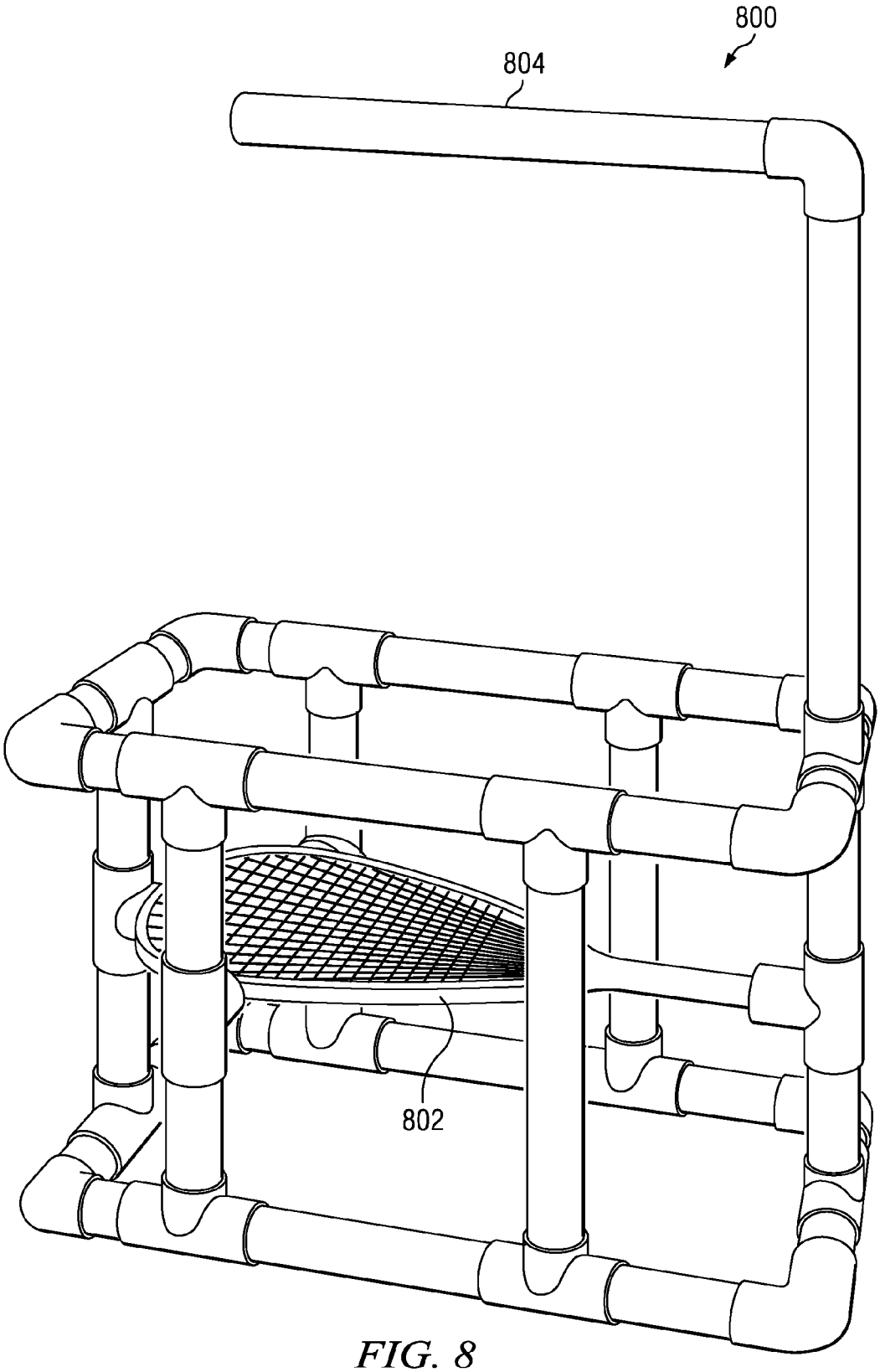
FIG. 8 is an isometric view of a test fixture used to test the vibration damping effects of the invention.
Figure 9:
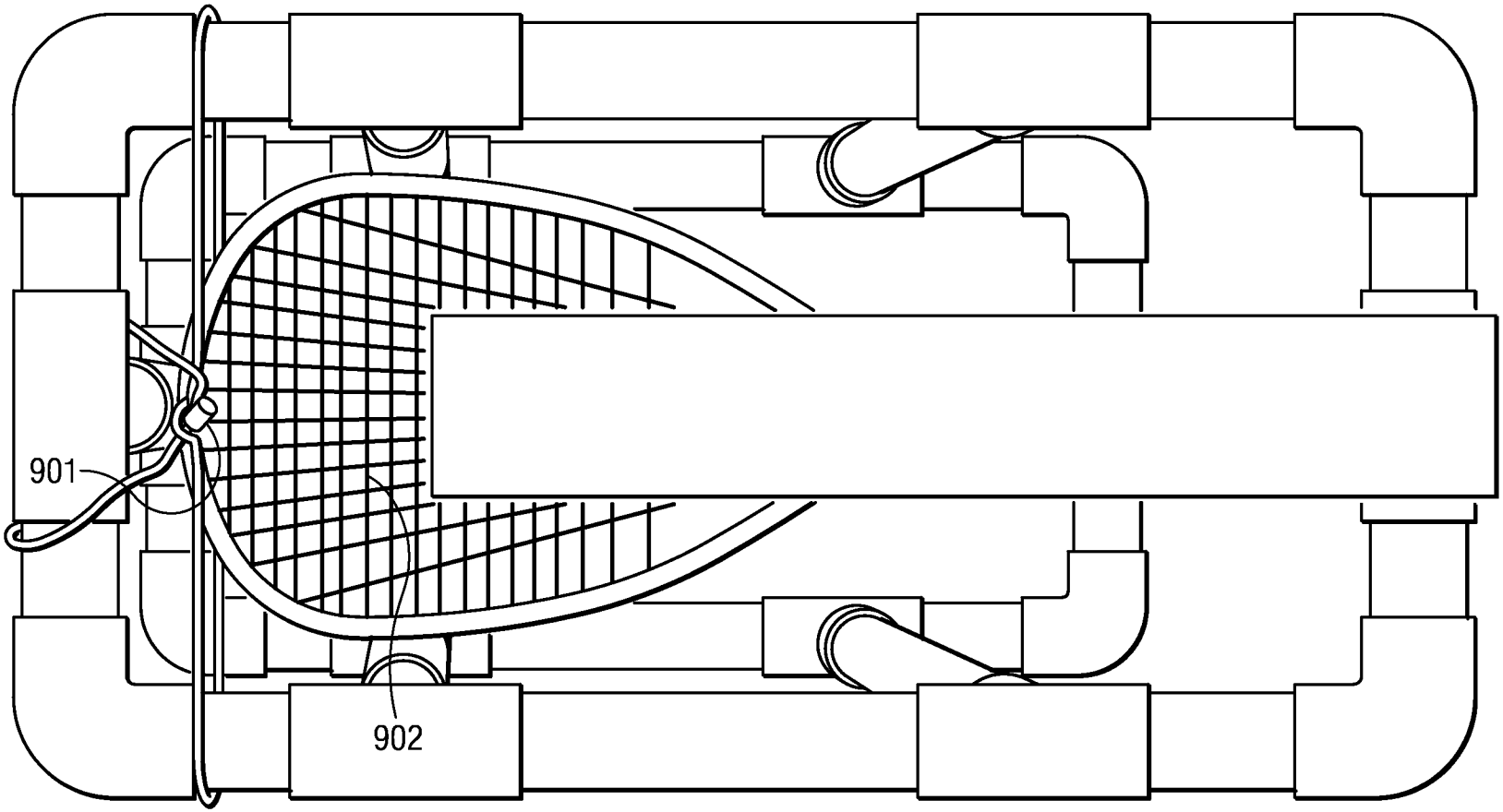
FIG. 9 is a top view of the test fixture.

Referring to FIGS. 8 and 9, a test apparatus 800 was constructed to perform the tests on the vibration damping qualities of the grommets with elongated barrels. The racquet 802 being tested was positioned in the fixture 800 and held in a fixed position. In the fixed position, the racquet frame did not move, only the strings moved when struck with a ball. A Pro Penn HD racquetball ball with a diameter of 2.5 inches and a weight of 1.4 ounces was dropped from a fixed position height 804 of two feet and oriented to strike a point equidistant from both sides of the racquet frame and four inches from the top of the frame 902. The vibration was measured via a microphone 901 located five inches above the string bed just above the top of the racquet frame. The microphone 901 identified sound waveforms caused by vibration when the racquet was struck with the ball. The microphone 901 was connected to a computer that was using Adobe Sound Booth Master Suite CS5 software.

In the data for both the racquet with the grommet strip with elongated barrels that extended 1.05 inches into the string bed (graphed on FIG. 11) and the prior art racquet without the elongated grommet barrels (i.e. grommets that extend no more than about 0.125 inches into the string bed shown in FIG. 1) (graphed on FIG. 10), during the strike of the ball or the initial "pop," the sound level was very intense. The sound level recorded upon the strike had a peak of approximately 18 decibels above the ambient noise level. For the prior art racquet, the initial vibration lasted for 0.02 seconds. The initial vibration lasted 0.01 seconds for the dampened racquet with the barrel extending about 1.05 inches into the string bed.

Figure 10:
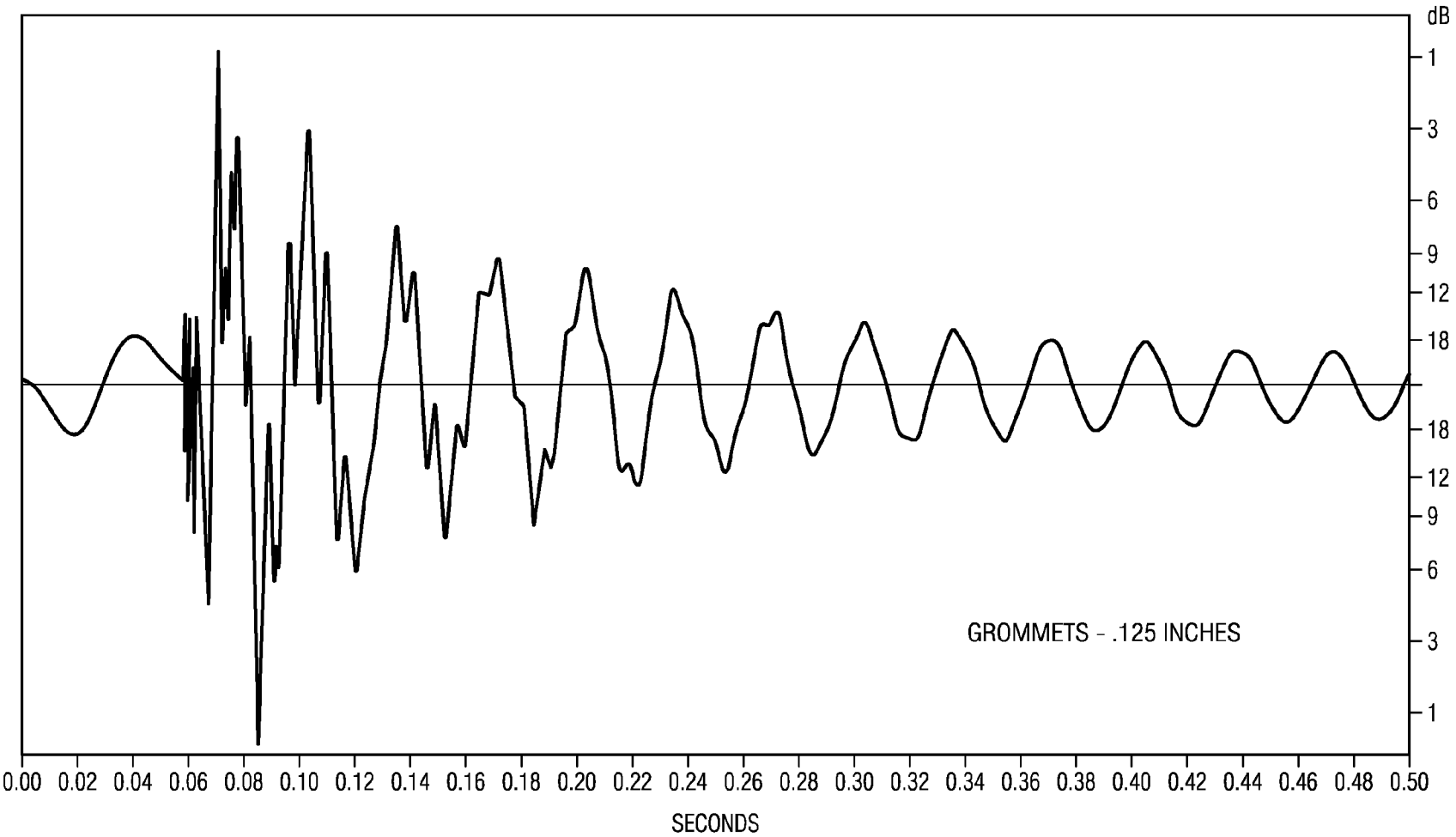
FIG. 10 is a graph showing vibration intensity for a racquet with prior art grommets, as measured using the test fixture of FIGS. 8 and 9 after a ball is dropped on the string bed.
Figure 11:
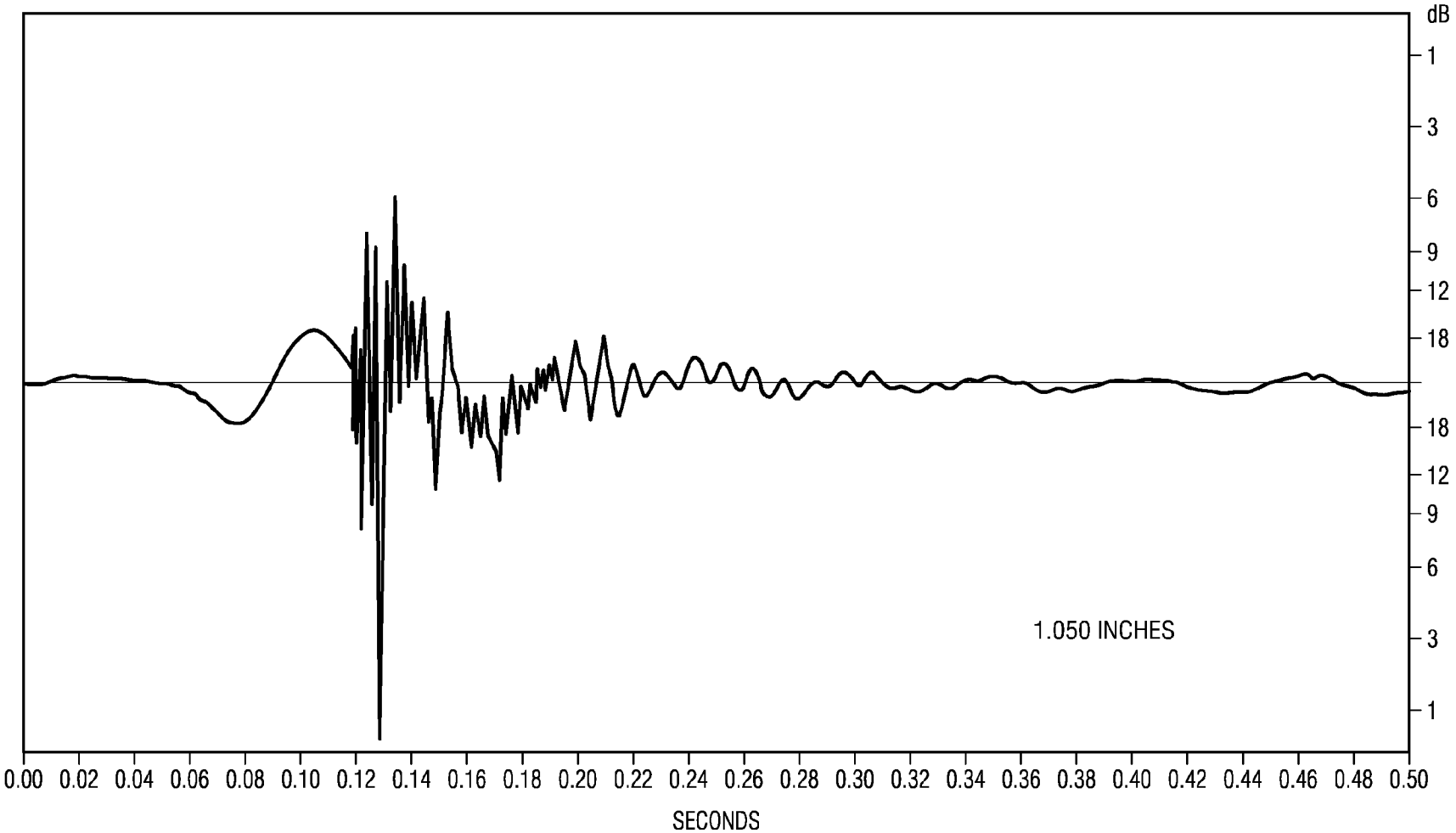
FIG. 11 is a graph showing vibration intensity for a racquet with grommets that extend into the string bed 1.05 inches, according to the present invention, as measured using the test fixture of FIGS. 8 and 9 after a ball is dropped on the string bed.

As can also be seen by comparing FIG. 10 to FIG. 11, vibration falls off immediately after the ball strike with the dampened racquet but vibration continues on the undampened racquet. Specifically, vibration decayed to approximately zero with no residual vibration within 0.14 seconds of the ball strike for the dampened racquet. There is a low frequency wave that continues before decaying to zero.

Figure 12:
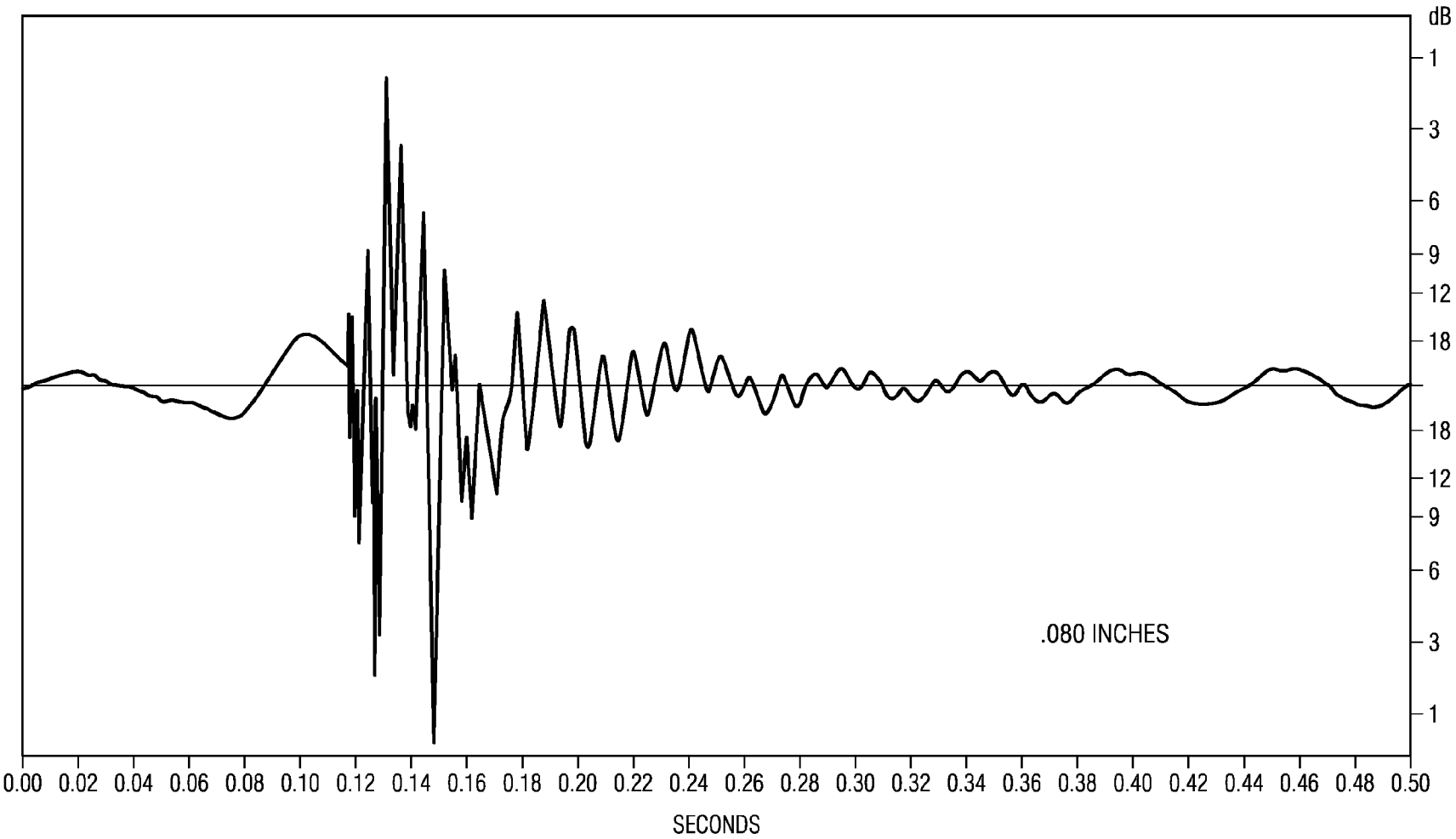
FIG. 12 is a graph showing vibration intensity for a racquet with grommets that extend into the string bed 0.8 inches, according to the present invention, as measured using the test fixture of FIGS. 8 and 9 after a ball is dropped on the string bed.
Figure 13:
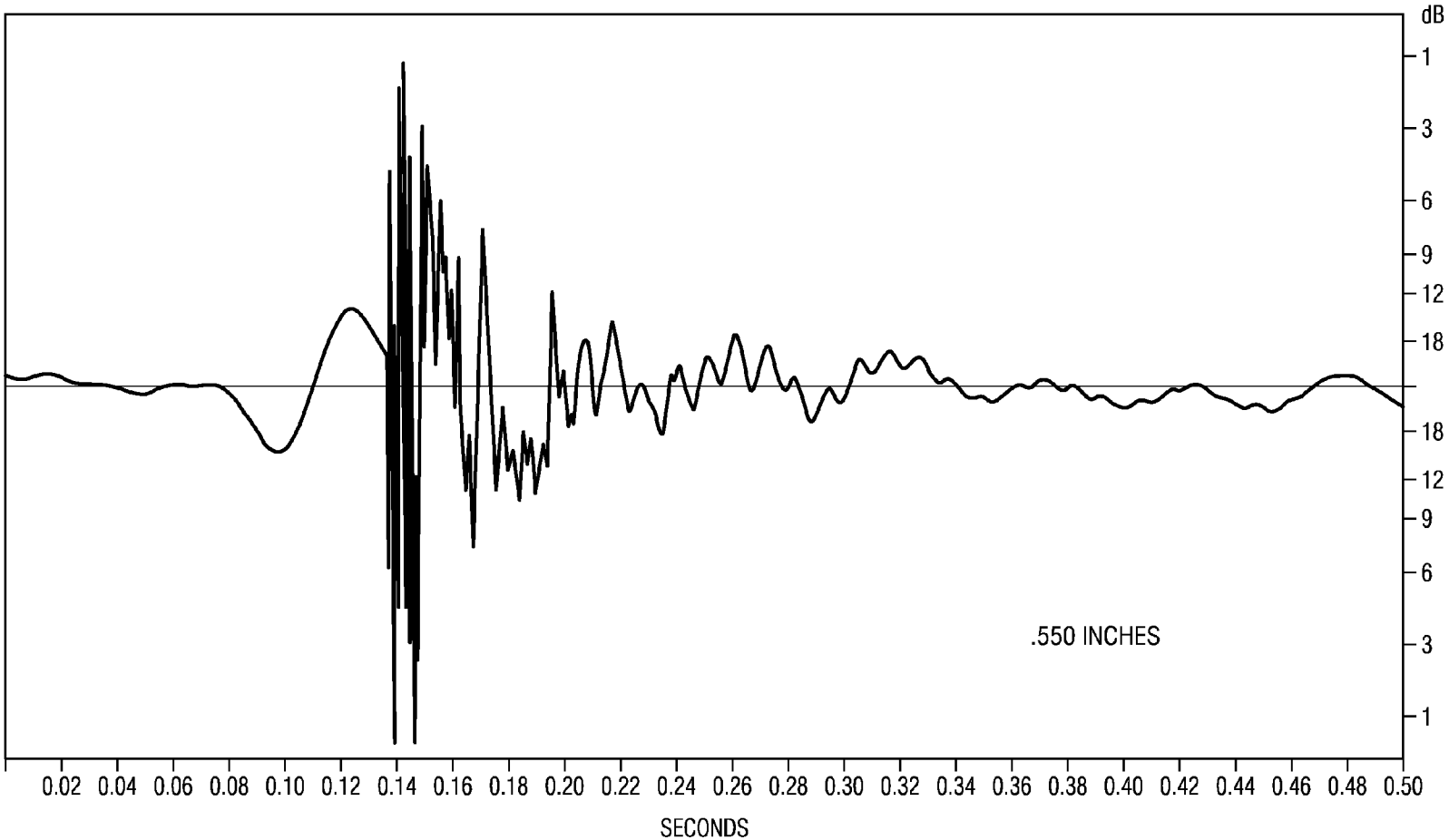
FIG. 13 is a graph showing vibration intensity for a racquet with grommets that extend into the string bed 0.55 inches, according to the present invention, as measured using the test fixture of FIGS. 8 and 9 after a ball is dropped on the string bed.

Additionally, FIG. 12 demonstrates the vibration damping effects of a grommet with an elongated barrel that extends about 0.8 inches into the string bed. Here, the vibration decayed to zero in approximately 0.32 seconds. In FIG. 13, the vibration damping effects of a grommet with an elongated barrel that extends about 0.55 inches into the string bed demonstrated a decay to zero in approximately 0.38 seconds.

In contrast, the undampened racquet, FIG. 10, had large-amplitude vibration which continued beyond 0.5 seconds.

Thus, the elongated grommet barrels provide much improved vibration damping characteristics that will reduce wear on a players hand, arm and shoulders and provide more comfort during play.

In summary, the claimed invention provides increased vibration damping while minimally affecting the weight and balance of the racquet. While illustrated embodiments of the present invention have been described and illustrated in the appended drawings, the present invention is not limited thereto but only by the scope and spirit of the appended claims.

We claim:

1. A sports racquet comprising:

a racquet frame having a head laterally surrounding a string bed, and having a lateral interior surface, the string bed residing in a string bed plane, a string bed boundary formed by the intersection of the interior surface of the head and the string bed plane;

a plurality of grommet holes disposed to be around at least a portion of the head;

the string bed having a plurality of strings at least some of the strings received into respective grommet holes in the head, each of the strings received into respective grommet holes having a string outer surface;

at least one elongate grommet strip disposed adjacent to the grommet holes;

a plurality of grommets attached in spaced apart relation to the grommet strip, extending from the grommet strip at an angle to the length of the grommet strip, and inserted into respective ones of the grommet holes;

each grommet including an elongated vibration damping barrel closely enclosing a string and extending into the string bed from the string bed boundary by about at least 0.55 inches; and each elongated vibration damping barrel having a continuous interior wall, a gap measured between a distance from a point on the string outer surface to a closest point on the continuous interior wall, the gap having a minimum measurement of about 0.125 millimeters.

2. The racquet of claim 1, wherein each grommet with an elongated barrel extends into the string bed from the string bed boundary by about at least 0.8 inches.

3. The racquet of claim 1, wherein each grommet with an elongated barrel extends into the string bed from the string bed boundary by about at least 1.05 inches.

4. The racquet of claim 1, wherein the strings have a predetermined diameter, an interior diameter of each grommet with an elongated barrel being in the range of about 1.2 to 1.5 times the string diameter.

5. The racquet of claim 1, wherein the elongated barrel has an interior diameter in the range of about 1.5-1.6 millimeters.

6. The racquet of claim 1, wherein the strings include a plurality of cross strings intersecting a plurality of main strings, the grommets with elongated barrels being disposed on the cross strings.

7. The racquet of claim 6, wherein at least fourteen grommets with elongated barrels are disposed on the cross strings.

8. The racquet of claim 6, wherein for each cross string on which a grommet with an elongated barrel is disposed, a second grommet with an elongated barrel is disposed at an opposed intersection of the string bed boundary and the cross string.

9. The racquet of claim 6, and further including a handle joined to the head, a longitudinal axis of the racquet extending through the handle, the cross strings disposed in spaced and parallel relation to each other at an angle to the axis at different distances from the handle and being at least six in number, grommets with elongated barrels disposed on only those cross strings which are at least five cross strings removed from the handle.

10. The racquet of claim 9, wherein the grommets with elongated barrels are disposed on at least seven cross strings, the cross strings being between about 15.5 inches and about 19 inches from the terminus of the racquet handle.

11. The racquet of claim 1, wherein the grommets with elongated barrels are disposed on three grommet strips.

12. The racquet of claim 1, wherein grommets with short barrels are disposed in remaining grommet holes.

13. The racquet of claim 1, wherein each grommet with an elongated barrel is made of a polymer consisting essentially of polyether with an amide blocker.

14. The racquet of claim 1, wherein each grommet with an elongated barrel is made of a polyamide.

15. A sports racquet comprising:

a racquet frame having a head laterally surrounding a string bed, and having a lateral interior surface, the string bed residing in a string bed plane, a string bed boundary formed by the intersection of the interior surface of the head and the string bed plane;

a plurality of grommet holes disposed to be around at least a portion of the head;

a string bed having a plurality of main strings and a plurality of cross strings intersecting the main strings, the cross strings received into respective grommet holes in the head, the cross stings having a string outer surface;

at least one elongate grommet strip disposed adjacent to the grommet holes;

a plurality of grommets attached in spaced apart relation to the grommet strip extending from the grommet strip at an angle to the length of the grommet strip and inserted into respective ones of the grommet holes;

ones of the grommets each including an elongated vibration damping barrel closely enclosing a cross string, and extending into the string bed from the string bed boundary to no more than about 33 millimeters from the nearest main string; and each elongated vibration damping barrel having a continuous interior wall, a gap measured between a distance from a point on the string outer surface to a closest point on the continuous interior wall, the gap having a minimum measurement of about 0.125 millimeters.

16. The racquet of claim 15, wherein the cross string has a predetermined diameter, an interior diameter of each grommet with an elongated barrel being in the range of about 1.2-1.5 times the cross string diameter.

17. The racquet of claim 15, wherein the elongated barrel has an interior diameter in the range of about 1.5-1.6 millimeters.

18. The racquet of claim 15, wherein at least fourteen grommets with elongated barrels are disposed on the cross strings.

19. The racquet of claim 15, wherein for each cross string on which a grommet with an elongated barrel is disposed, a second grommet with an elongated barrel is disposed at an opposed intersection of the string bed boundary and the cross string.

20. The racquet of claim 15, and further including a handle joined to the head, a longitudinal axis of the racquet extending through the handle, the cross strings disposed in spaced and parallel relation to each other at an angle to the axis at different distances from the handle and being at least six in number, grommets with elongated barrels disposed on only those cross strings which are at least five cross strings removed from the handle.

21. The racquet of claim 15, wherein the grommets with elongated barrels are disposed on at least seven cross strings, the cross strings being between about 15.5 inches and about 19 inches from the terminus of the racquet handle.

22. The racquet of claim 15, wherein the grommets with elongated barrels are disposed on three grommet strips.

23. The racquet of claim 15, wherein grommets with short barrels are disposed on remaining grommet holes.

24. The racquet of claim 15, wherein each grommet with an elongated barrel is made of a polymer consisting essentially of polyether with an amide blocker.

25. The racquet of claim 15, wherein each grommet with an elongated barrel is made of a polyamide.

26. A sports racquet comprising:

a racquet frame having a head laterally surrounding a string bed, and having a lateral interior surface, the string bed residing in a string bed plane, a string bed boundary formed by the intersection of the interior surface of the head and the string bed plane;

a plurality of grommet holes disposed to be around at least a portion of the head;

the string bed having a plurality of main strings and a plurality of cross strings intersecting the main strings, the cross strings received into respective grommet holes in the head, each of the cross strings having a string outer surface;

at least one elongate grommet strip disposed adjacent to the grommet holes;

a plurality of grommets attached in spaced apart relation to the grommet strip, extending from the grommet strip at an angle to the length of the grommet strip, and inserted into respective ones of the grommet holes;

each grommet including an elongated vibration damping barrel closely enclosing about at least 30% of the length of the cross string between the string bed boundary and the first main string; and each elongated vibration damping barrel having a continuous interior wall, a gap measured between a distance from a point on the string outer surface to a closest point on the continuous interior wall, the gap having a minimum measurement of about 0.125 millimeters.

27. The racquet of claim 26, wherein each grommet with an elongated barrel closely enclosing about at least 44% of the length of the cross string between the string bed boundary and the first main string.

28. The racquet of claim 26, wherein each grommet with an elongated barrel closely enclosing about at least 58% of the length of the cross string between the string bed boundary and the first main string.

29. The racquet of claim 26, wherein the cross string has a predetermined diameter, an interior diameter of each grommet with an elongated barrel being in the range of about 1.2-1.5 times the cross string diameter.

30. The racquet of claim 26, wherein each grommet with an elongated barrel has an interior diameter in the range of about 1.5-1.6 millimeters.

31. The racquet of claim 26, wherein at least fourteen grommets with elongated barrels are disposed on the cross strings.

32. The racquet of claim 26, wherein for each cross string on which a grommet with an elongated barrel is disposed, a second grommet with an elongated barrel is disposed at an opposed intersection of the string bed boundary and the cross string.

33. The racquet of claim 26, and further including a handle joined to the head, a longitudinal axis of the racquet extending through the handle, the cross strings disposed in spaced and parallel relation to each other at an angle to the axis at different distances from the handle and being at least six in number, grommets with elongated barrels disposed on only those cross strings which are at least five cross strings removed from the handle.

34. The racquet of claim 26, wherein the grommets with elongated barrels are disposed on seven consecutive cross strings.

35. The racquet of claim 33, wherein the grommets with elongated barrels are disposed on at least seven cross strings, the cross strings being between about 15.5 inches and about 19 inches from the terminus of the racket handle.

36. The racquet of claim 26, wherein the grommets with elongated barrels are disposed on three grommet strips.

37. The racquet of claim 26, wherein grommets with short barrels are disposed in remaining grommet holes.

38. The racquet of claim 26, wherein each grommet with an elongated barrel is made of a polymer consisting essentially of polyether with an amide blocker.

39. The racquet of claim 26, wherein each grommet with an elongated barrel is made of a polyamide.

* * * * *